US011707176B2

(12) United States Patent
Yamada et al.

(10) Patent No.: US 11,707,176 B2
(45) Date of Patent: Jul. 25, 2023

(54) UPRIGHT VACUUM CLEANER

(71) Applicant: MAKITA CORPORATION, Anjo (JP)

(72) Inventors: Keisuke Yamada, Anjo (JP); Takayuki Tahara, Anjo (JP)

(73) Assignee: MAKITA CORPORATION, Anjo (JP)

( * ) Notice: Subject to any disclaimer, the term of this patent is extended or adjusted under 35 U.S.C. 154(b) by 451 days.

(21) Appl. No.: 16/789,554

(22) Filed: Feb. 13, 2020

(65) Prior Publication Data

US 2020/0281432 A1 Sep. 10, 2020

(30) Foreign Application Priority Data

Mar. 5, 2019 (JP) ..... JP2019-039484

(51) Int. Cl.

| | |
|---|---|
| ***A47L 9/28*** | (2006.01) |
| ***A47L 9/04*** | (2006.01) |
| ***A47L 5/28*** | (2006.01) |

(52) U.S. Cl.

CPC ..... *A47L 9/2884* (2013.01); *A47L 5/28* (2013.01); *A47L 9/04* (2013.01)

(58) Field of Classification Search

CPC . A47L 9/2884; A47L 5/28; A47L 9/04; A47L 9/009; A47L 9/0494; A47L 9/122; A47L 5/22; A47L 9/00; A47L 9/0477; A47L 9/1418

See application file for complete search history.

(56) References Cited

U.S. PATENT DOCUMENTS

| | | | | |
|---|---|---|---|---|
| 3,328,820 A | | 7/1967 | Doersam | |
| 4,594,807 A | | 6/1986 | McQueen | |
| 5,020,186 A | * | 6/1991 | Lessig, III | A47L 5/30 D32/22 |
| 5,109,566 A | | 5/1992 | Kobayashi et al. | |

(Continued)

FOREIGN PATENT DOCUMENTS

| | | |
|---|---|---|
| CN | 1368030 A | 9/2002 |
| CN | 1778247 A | 5/2006 |

(Continued)

OTHER PUBLICATIONS

Amazon, Replacement Battery, 2017, https://www.amazon.com/Replacement-Battery-Batteries-LBXR20-OPE-LBXR2020/dp/B074P34RBL/ref=sr_1_8?ie=UTF8&qid=1515030364&sr=8-8&keywords=cordless+drill+replacement+battery (Year: 2017).*

(Continued)

*Primary Examiner* — Thomas Raymond Rodgers
(74) *Attorney, Agent, or Firm* — J-Tek Law PLLC; Jeffrey D. Tekanic; Scott T. Wakeman

(57) ABSTRACT

An upright vacuum cleaner includes a main-body part (10) having a dust-collection chamber (14) fluidly connected to a motor chamber (13) via a coupling pipe (15). A fan (13*f*) and a motor (13*m*) are housed in the motor chamber. A cleaner head (20) is pivotably and fluidly connected to the main-body part and suctions air through a suction opening (23) when a suction force is generated by the fan and the motor in the motor chamber. A straight suction passageway (24) extends through a central portion of the interior of the cleaner head in plan view. One or more batteries (50) is/are disposed within the cleaner head spaced apart (outward) from the suction passageway in the plan view.

10 Claims, 12 Drawing Sheets

(56) References Cited

U.S. PATENT DOCUMENTS

| | | | | |
|---|---|---|---|---|
| 5,274,878 | A | 1/1994 | Radabaugh et al. | |
| 5,995,884 | A | 11/1999 | Allen et al. | |
| 6,151,749 | A | 11/2000 | Berfield | |
| 6,295,692 | B1 | 10/2001 | Shideler | |
| 6,553,612 | B1 | 4/2003 | Dyson et al. | |
| 6,568,026 | B2 | 5/2003 | Roy et al. | |
| 6,581,239 | B1 | 6/2003 | Dyson et al. | |
| 7,492,124 | B2 | 2/2009 | Johnson et al. | |
| 7,769,490 | B2 | 8/2010 | Abramson et al. | |
| 8,001,653 | B1 * | 8/2011 | Longley | A47L 5/30 15/403 |
| 8,354,183 | B2 | 1/2013 | Konuma et al. | |
| 8,733,470 | B2 | 5/2014 | Matthias et al. | |
| 8,842,427 | B2 | 9/2014 | Yoshimura et al. | |
| 9,456,722 | B2 | 10/2016 | Tomasiak et al. | |
| 9,532,688 | B1 | 1/2017 | Afrouzi et al. | |
| 10,874,273 | B2 * | 12/2020 | Han | A47L 9/2857 |
| 2003/0060928 | A1 | 3/2003 | Abramson et al. | |
| 2003/0201754 | A1 | 10/2003 | Conrad | |
| 2004/0078116 | A1 | 4/2004 | Hashimoto et al. | |
| 2005/0155177 | A1 | 7/2005 | Baer et al. | |
| 2006/0005346 | A1 | 1/2006 | Rupp et al. | |
| 2006/0107628 | A1 | 5/2006 | Yoshida et al. | |
| 2007/0174992 | A1 | 8/2007 | Murray et al. | |
| 2008/0052867 | A1 | 3/2008 | Park | |
| 2008/0062618 | A1 | 3/2008 | Frank et al. | |
| 2008/0148512 | A1 * | 6/2008 | Beskow | A47L 11/302 15/350 |
| 2008/0276407 | A1 | 11/2008 | Schnittman et al. | |
| 2008/0281470 | A1 | 11/2008 | Gilbert et al. | |
| 2009/0307865 | A1 | 12/2009 | Williamson et al. | |
| 2010/0050373 | A1 * | 3/2010 | Kaffenberger | H01M 50/247 15/383 |
| 2010/0062326 | A1 | 3/2010 | Konuma et al. | |
| 2010/0088843 | A1 * | 4/2010 | Reed | H01M 50/209 320/112 |
| 2010/0332067 | A1 | 12/2010 | Abramson | |
| 2011/0219579 | A1 * | 9/2011 | Conrad | A47L 9/22 15/352 |
| 2012/0011668 | A1 | 1/2012 | Schnittman et al. | |
| 2012/0112689 | A1 | 5/2012 | Sever et al. | |
| 2012/0251229 | A1 | 10/2012 | Liang et al. | |
| 2012/0265343 | A1 | 10/2012 | Gilbert et al. | |
| 2013/0117952 | A1 | 5/2013 | Schnittman et al. | |
| 2014/0079973 | A1 | 3/2014 | Liang et al. | |
| 2014/0151079 | A1 | 6/2014 | Furui et al. | |
| 2014/0159919 | A1 | 6/2014 | Furui et al. | |
| 2014/0304939 | A1 | 10/2014 | Suzuki | |
| 2015/0214758 | A1 | 7/2015 | Toya et al. | |
| 2015/0223652 | A1 * | 8/2015 | Koura | A47L 9/22 15/327.2 |
| 2015/0366133 | A1 | 12/2015 | Nojiri et al. | |
| 2016/0095487 | A1 | 4/2016 | Koura et al. | |
| 2016/0151846 | A1 | 6/2016 | Suzuki | |
| 2016/0175895 | A1 | 6/2016 | Suzuki | |
| 2016/0220083 | A1 * | 8/2016 | Thorne | A47L 9/0411 |
| 2016/0293912 | A1 | 10/2016 | Manion et al. | |
| 2016/0302636 | A1 * | 10/2016 | Kim | A47L 9/2847 |
| 2017/0007085 | A1 | 1/2017 | Tahara | |
| 2017/0193761 | A1 | 7/2017 | Suzuki | |
| 2018/0126534 | A1 | 5/2018 | Iida et al. | |
| 2018/0126537 | A1 | 5/2018 | Tanaka et al. | |
| 2018/0229317 | A1 | 8/2018 | Suzuki | |
| 2018/0365962 | A1 | 12/2018 | Kusakawa et al. | |
| 2019/0022775 | A1 | 1/2019 | Suzuki | |

FOREIGN PATENT DOCUMENTS

| | | | | |
|---|---|---|---|---|
| CN | 102293609 | A | 12/2011 | |
| CN | 103974652 | A | 8/2014 | |
| CN | 104840147 | A | 8/2015 | |
| CN | 204813699 | U | 12/2015 | |
| CN | 108201408 | A | 6/2018 | |
| DE | 1428497 | A1 | 3/1969 | |
| DE | 69910252 | | 7/2004 | |
| DE | 102005007923 | A1 | 8/2006 | |
| DE | 102010043582 | A1 | 5/2012 | |
| DE | 102011004319 | A1 | 8/2012 | |
| GB | 1027111 | A | 4/1966 | |
| JP | S63311923 | A | 12/1988 | |
| JP | H02241423 | A | 9/1990 | |
| JP | H0453515 | A | 2/1992 | |
| JP | H0588472 | U | 12/1993 | |
| JP | H0670872 | A | 3/1994 | |
| JP | H0751200 | A | 2/1995 | |
| JP | H11285158 | A | 10/1999 | |
| JP | 2001137158 | A | 5/2001 | |
| JP | 2001169974 | A | 6/2001 | |
| JP | 2002224631 | A | 8/2002 | |
| JP | 2002532178 | A | 10/2002 | |
| JP | 2002320573 | A | 11/2002 | |
| JP | 2002320579 | A | 11/2002 | |
| JP | 2002360479 | A | 12/2002 | |
| JP | 2002360480 | A | 12/2002 | |
| JP | 2005313657 | A | 11/2005 | |
| JP | 2006043302 | A | 2/2006 | |
| JP | 2006174971 | A | 7/2006 | |
| JP | 2006305248 | A | 11/2006 | |
| JP | 2008036723 | A | 2/2008 | |
| JP | 2008061674 | A | 3/2008 | |
| JP | 2008155041 | A | 7/2008 | |
| JP | 2010178773 | A | 8/2010 | |
| JP | 2011244724 | A | 12/2011 | |
| JP | 2011244780 | A | 12/2011 | |
| JP | 455332 | B2 | 6/2012 | |
| JP | 2013192867 | A | 9/2013 | |
| JP | 2013239259 | A | 11/2013 | |
| JP | 2014008303 | A | 1/2014 | |
| JP | 2014030484 | A | 2/2014 | |
| JP | 2014036750 | A | 2/2014 | |
| JP | 2014083241 | A | 5/2014 | |
| JP | 2014111190 | A | 6/2014 | |
| JP | 2014147904 | A | 8/2014 | |
| JP | 2014155862 | A | 8/2014 | |
| JP | 2014180501 | A | 9/2014 | |
| JP | 2014200686 | A | 10/2014 | |
| JP | 2015084810 | A | 5/2015 | |
| JP | 2015091500 | A | 5/2015 | |
| JP | 2017018567 | A | 1/2017 | |
| JP | 2018007849 | A | 1/2018 | |
| WO | 0036962 | A1 | 6/2000 | |
| WO | 0038255 | A1 | 6/2000 | |
| WO | WO-2004014211 | A1 * | 2/2004 | A47L 5/28 |
| WO | 2011115121 | A1 | 9/2011 | |
| WO | 2013065390 | A1 | 5/2013 | |
| WO | 2014021116 | A1 | 2/2014 | |
| WO | 2014119160 | A1 | 8/2014 | |
| WO | 2014119732 | A1 | 8/2014 | |
| WO | WO-2014119192 | A1 * | 8/2014 | A47L 5/24 |
| WO | 2014131106 | A1 | 9/2014 | |
| WO | 2014155904 | A1 | 10/2014 | |

OTHER PUBLICATIONS

Translation of WO2014119192, retrieved from Espacenet on Dec. 19, 2022 (Year: 2014).*

Office Action and Search Report from the Chinese Patent Office dated Jan. 29, 2022, in counterpart Chinese application No. 202010020396.1, and machine translation thereof.

Office Action and Search Report from the Japanese Patent Office dated Aug. 30, 2022 in counterpart Japanese application No. 2019-039484, and machine translation thereof.

Office Action and Search Report from the Chinese Patent Office dated Jun. 17, 2022 in counterpart Chinese application No. 202010020396.1, and machine translation thereof.

* cited by examiner

UPRIGHT VACUUM CLEANER

CROSS-REFERENCE

The present application claims priority to Japanese patent application serial number 2019-039484 filed on Mar. 5, 2019, the contents of which are incorporated fully herein by reference.

TECHNICAL FIELD

The present invention generally relates to a battery-powered (cordless) upright vacuum cleaner (dust collector).

BACKGROUND ART

U.S. Patent Application Publication No. 2003/0201754 discloses a battery-powered upright vacuum cleaner that comprises: a main-body part (main or upper casing), which can be maintained in the state in which stands upright (perpendicular) relative to the floor surface and generates a suction force; a cleaner head (head part), which sucks in air using the suction force generated by the main-body part; and a connecting pipe, which fluidly connects the main-body part and the cleaner head. Because the batteries are disposed in the cleaner head of this known upright vacuum cleaner, the weight of the manually-operable portion (main-body part) is reduced and ease of operation is better than an embodiment in which the batteries are disposed in or on the main-body part.

SUMMARY OF THE INVENTION

However, because the above-described known upright vacuum cleaner provides the batteries at the center of the cleaner head in the left-right direction, it is necessary to divert a suction passageway, through which the suctioned air flows to the main-body-part, to a side portion of the cleaner head. Therefore, in this known embodiment, the suction force in the cleaner head may become unequal on the left and right sides, and there is a possibility that a sufficient suction force will not be ensured.

It is therefore one non-limiting object of the present teachings to disclose techniques for designing an upright vacuum cleaner such that ease of operation is improved and/or a sufficient suction force can be ensured.

According to one non-limiting aspect of the present teachings, an upright vacuum cleaner (dust collector) may include a main-body part (main or upper casing) that includes a coupling pipe, a dust-collection chamber fluidly connected to the coupling pipe, a motor chamber connected to the dust-collection chamber and in which a fan and a motor are housed, and an exhaust port through which air is exhausted from the motor chamber. The vacuum cleaner is configured/adapted to be maintained in the state in which the main-body part stands upright relative to a floor surface. The vacuum cleaner may further comprise: a cleaner head (head part), which is pivotably and fluidly connected to the main-body part and suctions air when a suction force is generated by the fan and motor; a suction passageway (tube), which is disposed inside the cleaner head, is rectilinear (straight) and passes through a central portion of the cleaner head in plan view, and through which suctioned air flows toward the main-body part; and one or more batteries (battery pack(s), battery cartridge(s)), which is/are disposed at a location or locations within the cleaner head that is/are spaced apart (outward) from the suction passageway in plan view. Such an upright vacuum cleaner (dust collector) is easier to use than the above-described known vacuum cleaner and ensures a sufficient suction force owing to the rational design of the airflow pathways.

Additional aspects, objects, embodiments and advantages of the present teachings will become apparent upon reading the following detailed description in view of the appended drawings and claims.

DETAILED DESCRIPTION OF EMBODIMENTS

Embodiments of an upright vacuum cleaner (dust collector) according to the present teachings will be explained below, based on the drawings. It is noted that the present invention is not limited by these embodiments. In addition, structural elements in the embodiments below include those that can be easily substituted by a person skilled in the art, or those that are substantially the same.

Figure 1:
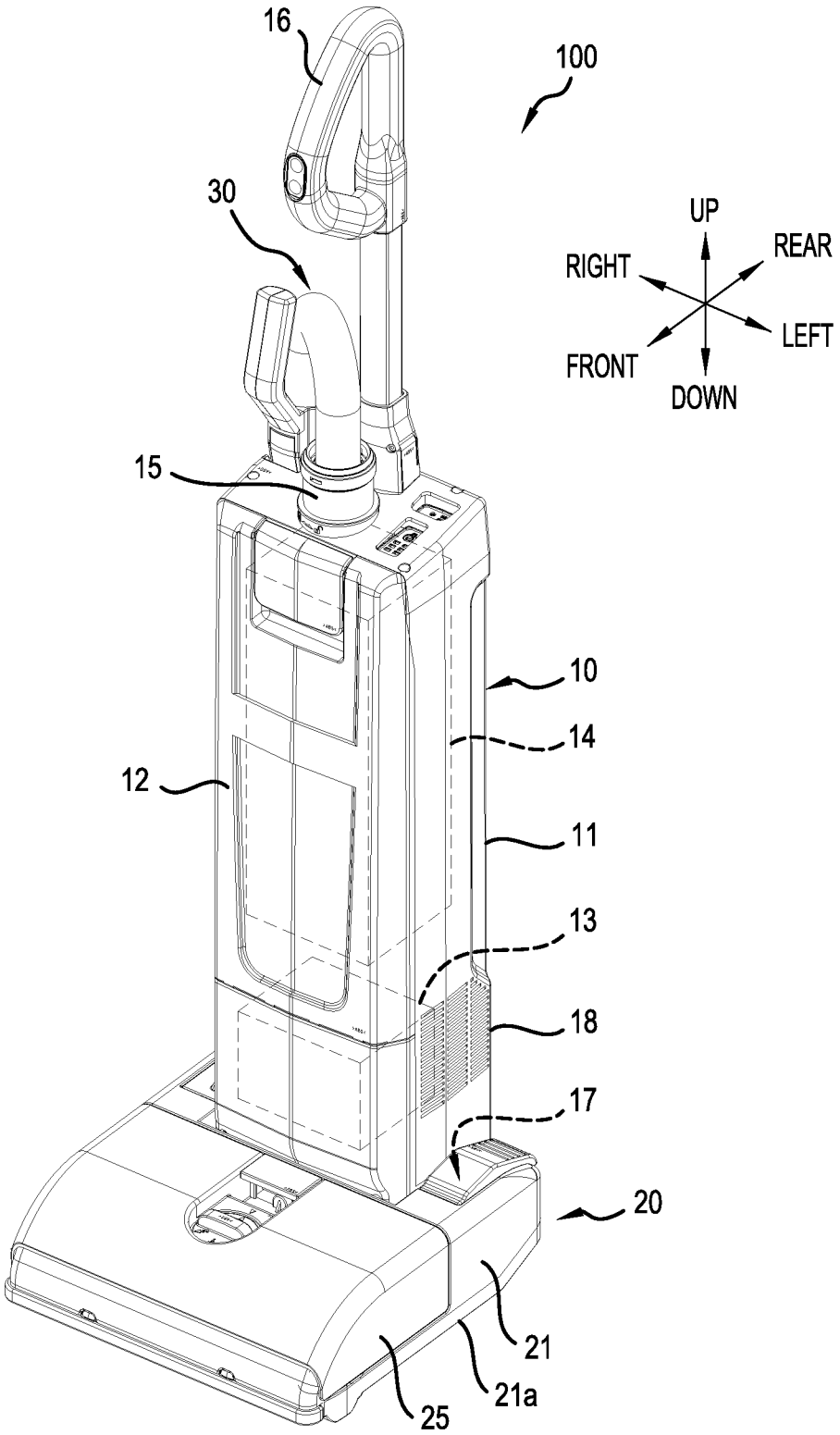
FIG. 1 is an oblique view that shows an upright vacuum cleaner according to a first exemplary embodiment of the present teachings.
Figure 2:
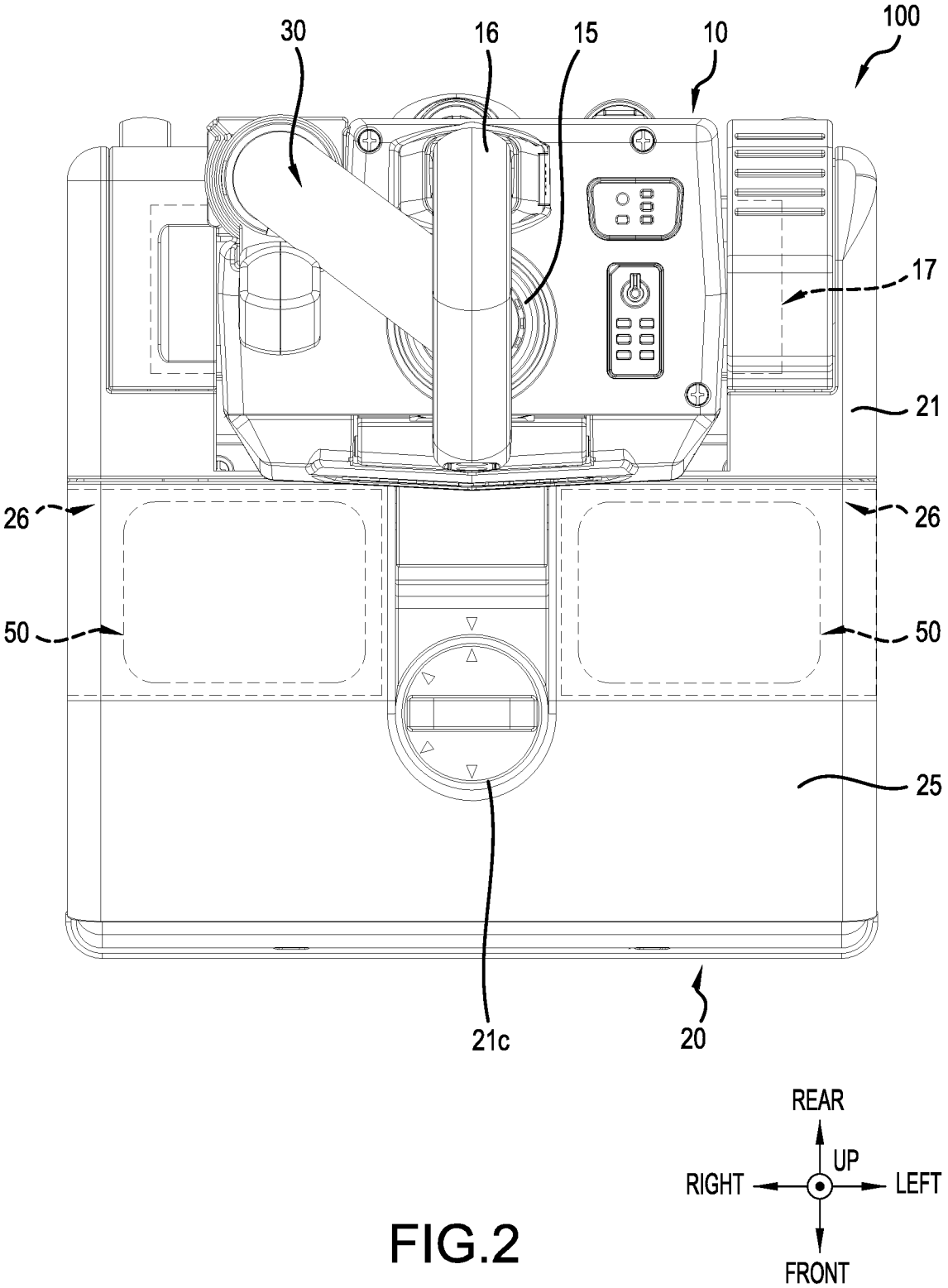
FIG. 2 is a plan view of the upright vacuum cleaner according to the first embodiment.
Figure 3:
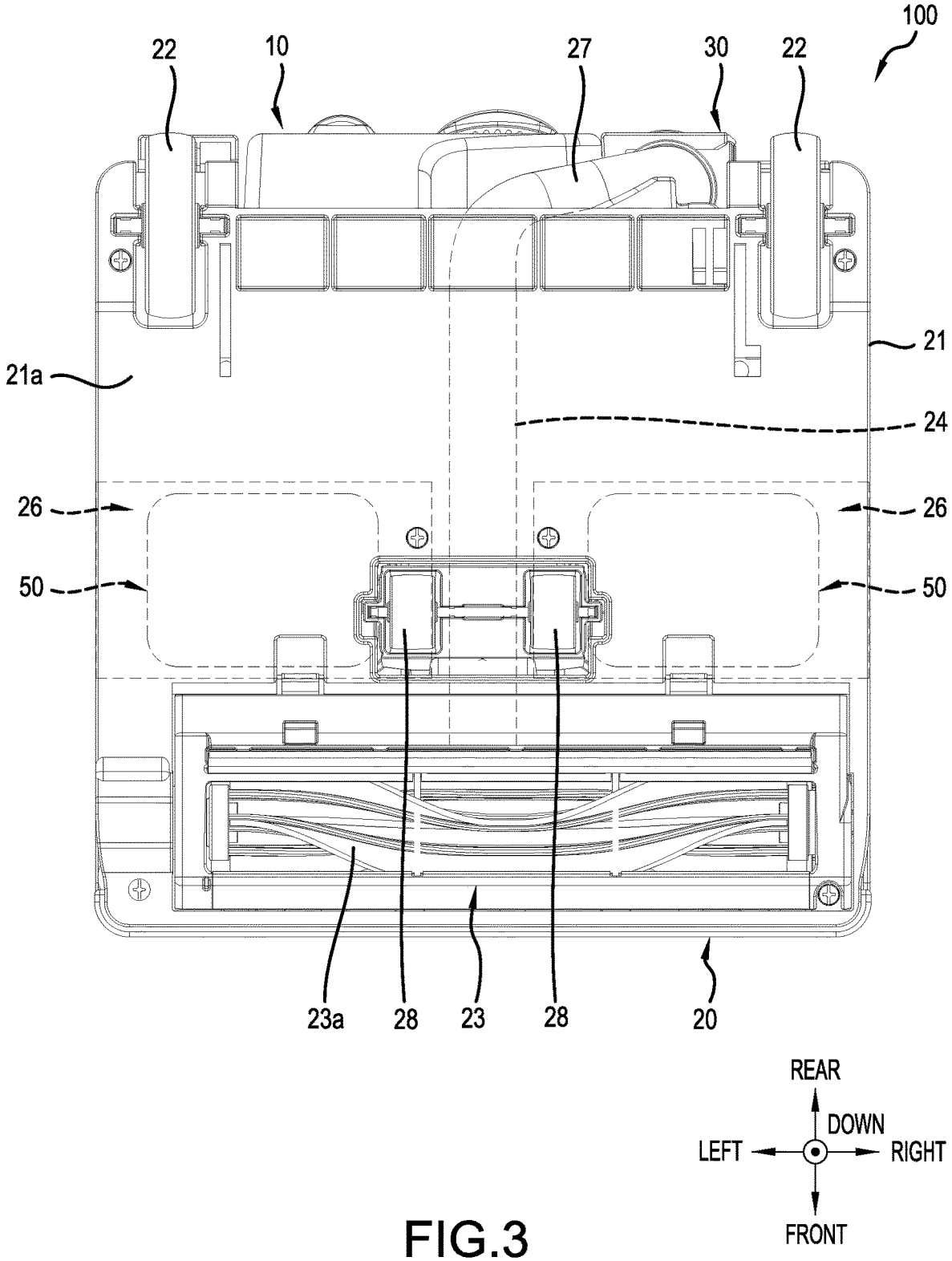
FIG. 3 is a bottom view of the upright vacuum cleaner according to the first embodiment.
Figure 4:
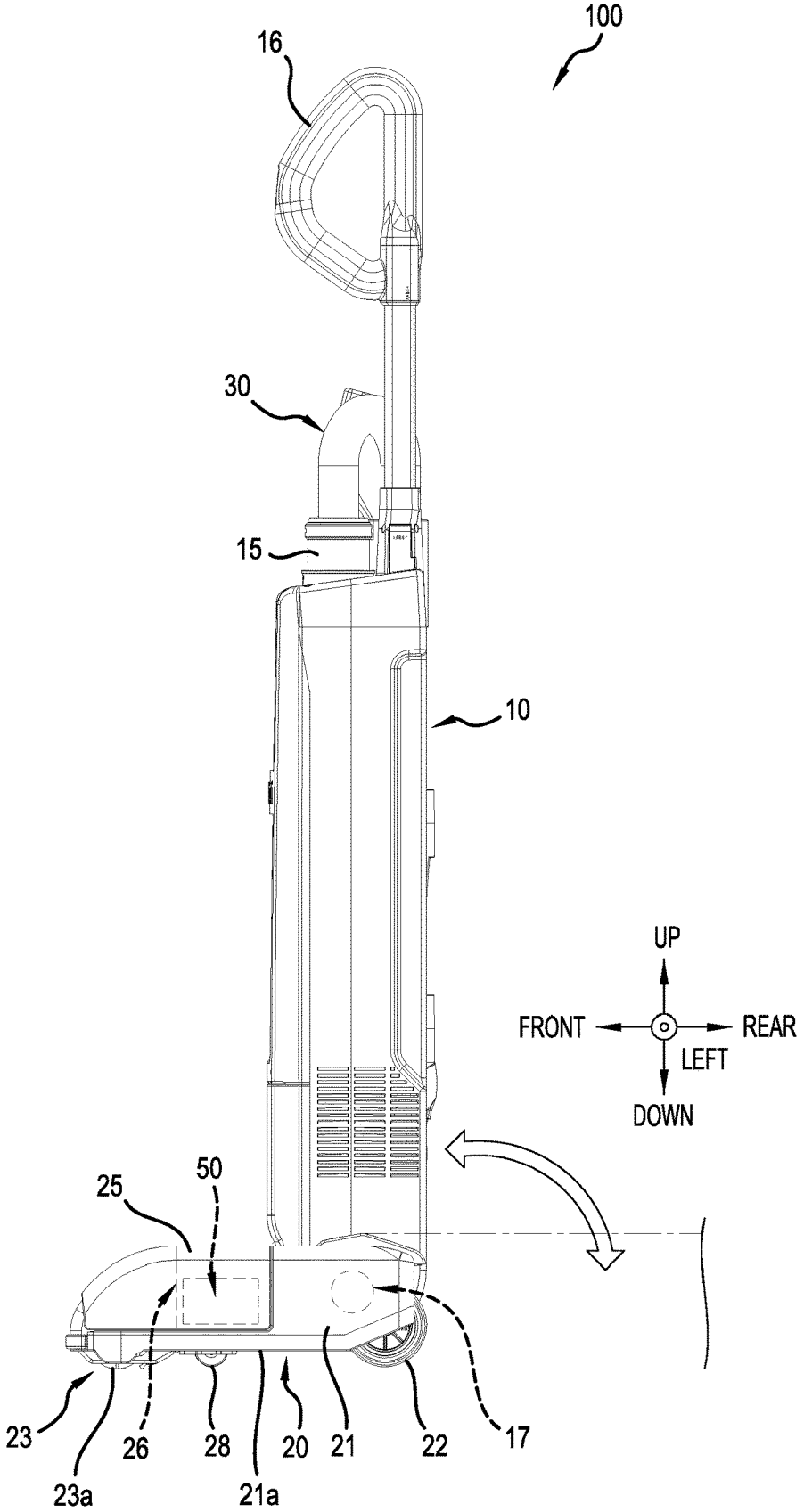
FIG. 4 is a side view of the upright vacuum cleaner according to the first embodiment.

FIGS. 1-4 show one exemplary example of an upright vacuum cleaner (dust collector) 100 according to the present teachings, in which FIG. 1 is an oblique view, FIG. 2 is a plan view, FIG. 3 is a bottom view, and FIG. 4 is a side view. The upright vacuum cleaner 100 shown in FIGS. 1-4 comprises a main-body part 10, a cleaner head (head part) 20, and a connecting pipe 30.

The upright vacuum cleaner 100 can be maintained (pivoted) such that the main-body part (main or upper casing) 10 stands upright (vertical or perpendicular) relative to the floor surface. When not in use, the upright vacuum cleaner 100 can be stored with the main-body part 10 standing upright. In addition, when in use, the main-body part 10 is tiltable (pivotable) relative to the floor surface (i.e. relative to the cleaner head 20). Thus, by moving the main-body part 10 while the cleaner head 20 is tilted (inclined) relative to the main-body part 10, the cleaner head 20 can be moved easily across the floor surface. It is noted that, in embodiments in which suctioning (vacuum cleaning) is to be performed directly via the connecting pipe 30 (i.e. not via the cleaner head 20) and an attachment (accessory), such as a brush, nozzle, etc., is connected to the connecting pipe 30, e.g., via a flexible hose, the suctioning also can be performed while the main-body part 10 stands upright relative to the floor surface. In the following, the configuration will be described in the state in which the main-body part 10 is in its upright position relative to the cleaner head 20 and the floor surface.

In the following, an exemplary case will be described in which dust, debris, etc. is collected (e.g., suctioned) from a floor surface that is parallel to the horizontal plane. The direction perpendicular to the floor surface is defined as the up-down direction, the direction leading away from the floor surface is defined as "up," and the direction leading toward the floor surface is defined as "down." In addition, the directions parallel to the floor surface are defined as the front-rear direction (a first direction) and the left-right direction (a second direction). When the main-body part 10 stands upright, the direction in which the cleaner head 20 protrudes from the main-body part 10 is defined as "front," and the direction opposite that of "front" is defined as "rear." In addition, when looking toward the "front," leftward is defined as "left," and rightward is defined as "right."

The main-body part (main casing) 10 comprises a housing 11 and an open/close cover 12. The housing 11 has, for example, a rectangular-box shape and is oriented such that the longitudinal (longer) direction of the housing 11 extends in the up-down direction. A lower end of the housing 11 is pivotably coupled to the cleaner head 20 via a coupling part (hinge) 17. The coupling part 17 comprises a shaft that extends in the left-right direction and pivotably supports the housing 11 relative to the cleaner head 20. By pivoting about the coupling part 17, the tilt angle of the housing 11 is adjustable between the state in which the main-body part 10 stands upright relative to the floor surface (see FIG. 4) and the state in which the main-body part 10 is parallel to the floor surface.

Figure 5:
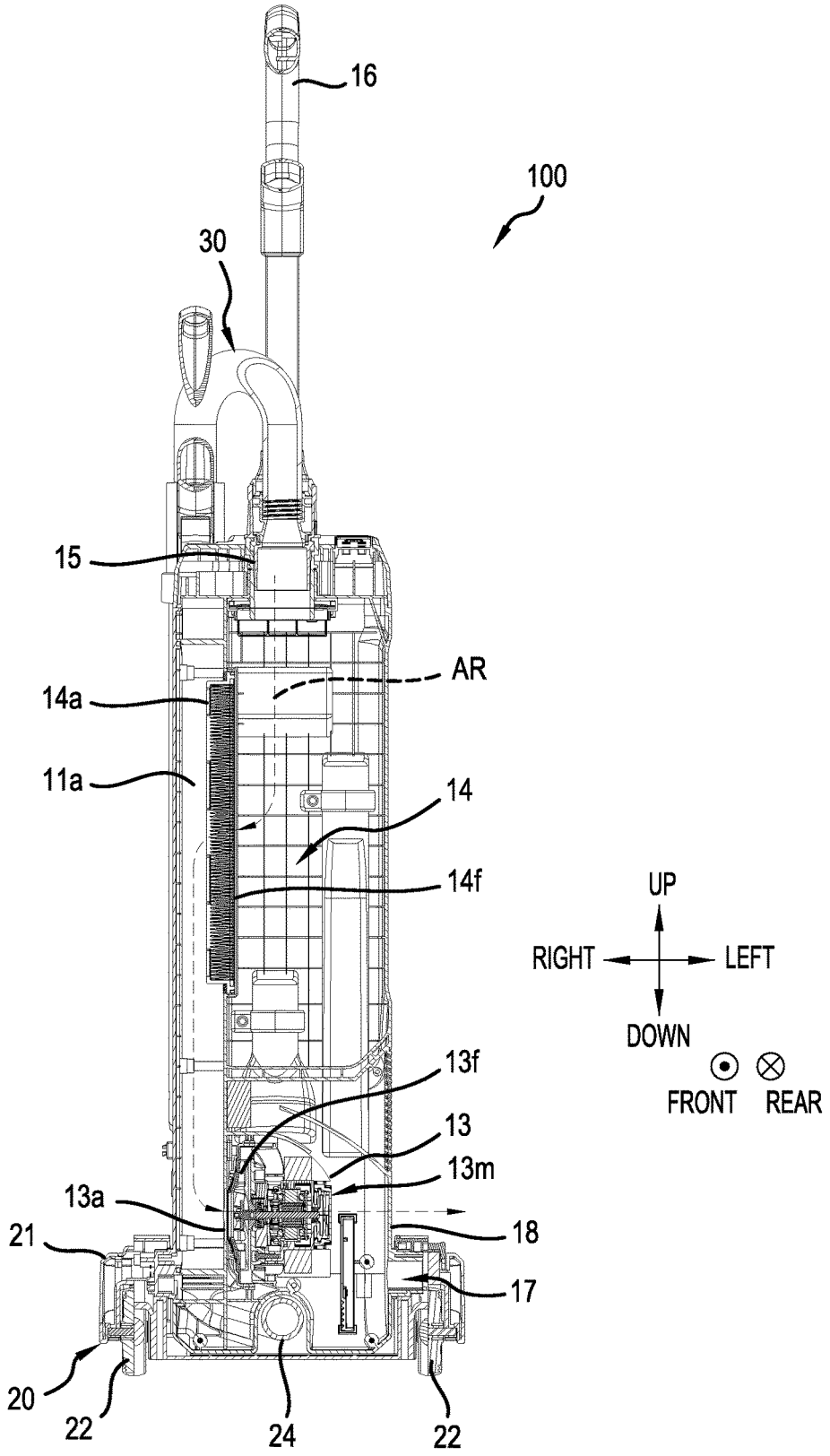
FIG. 5 is a cross-sectional view that shows one exemplary example of a representative main-body part (main casing) according to the first embodiment.
Figure 6:
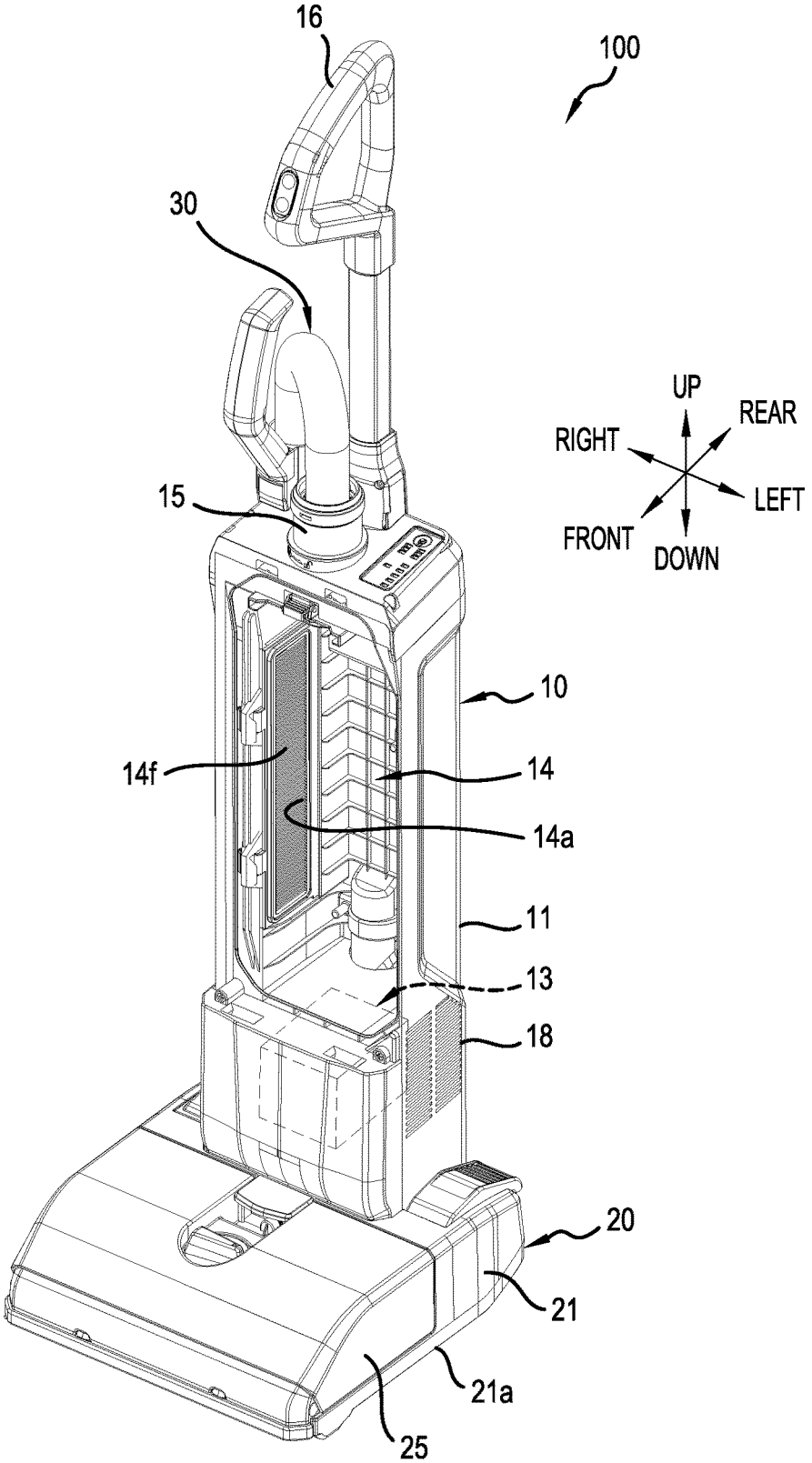
FIG. 6 is an oblique view of the main-body part.
Figure 7:
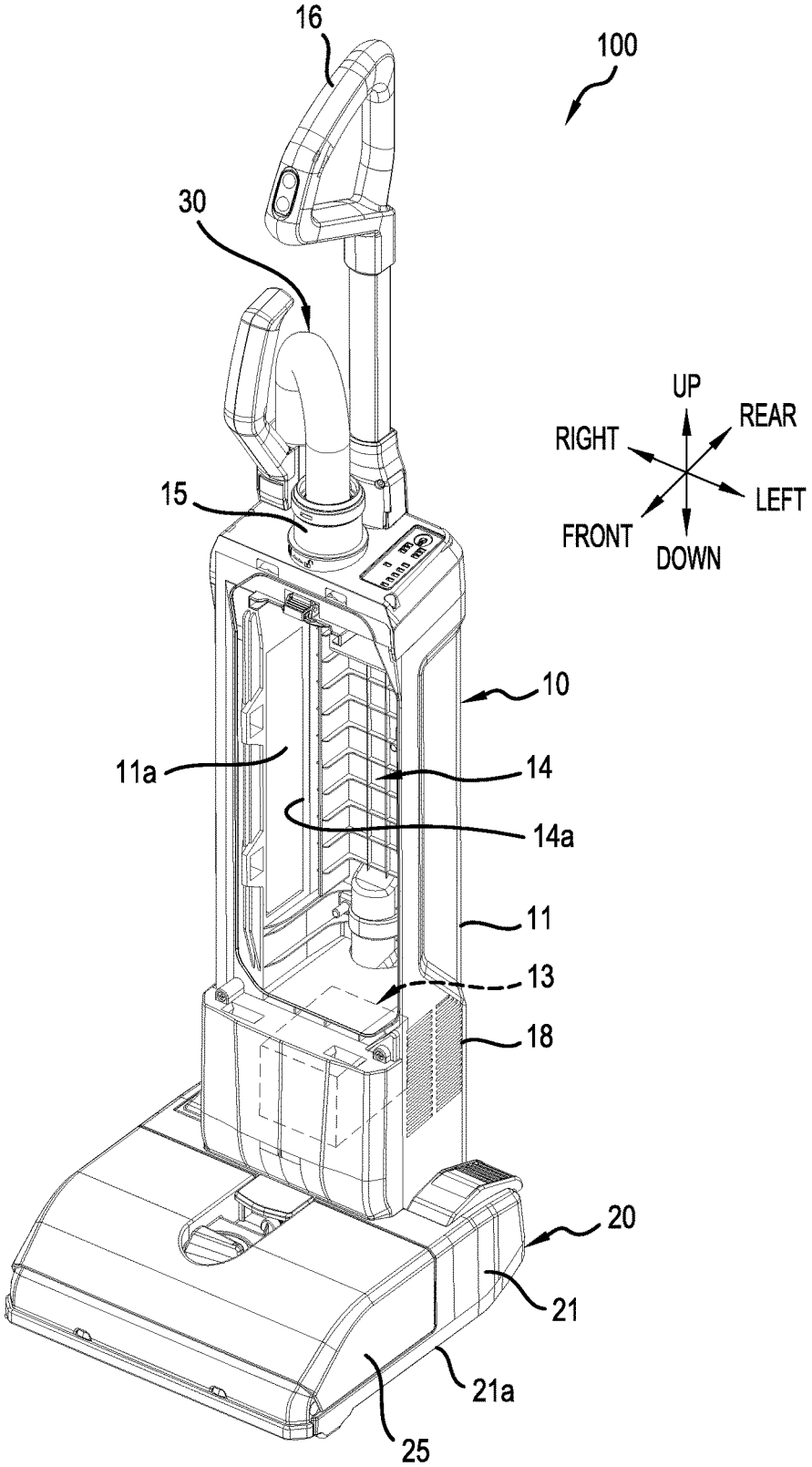
FIG. 7 is an oblique view of the main-body part.
Figure 8:
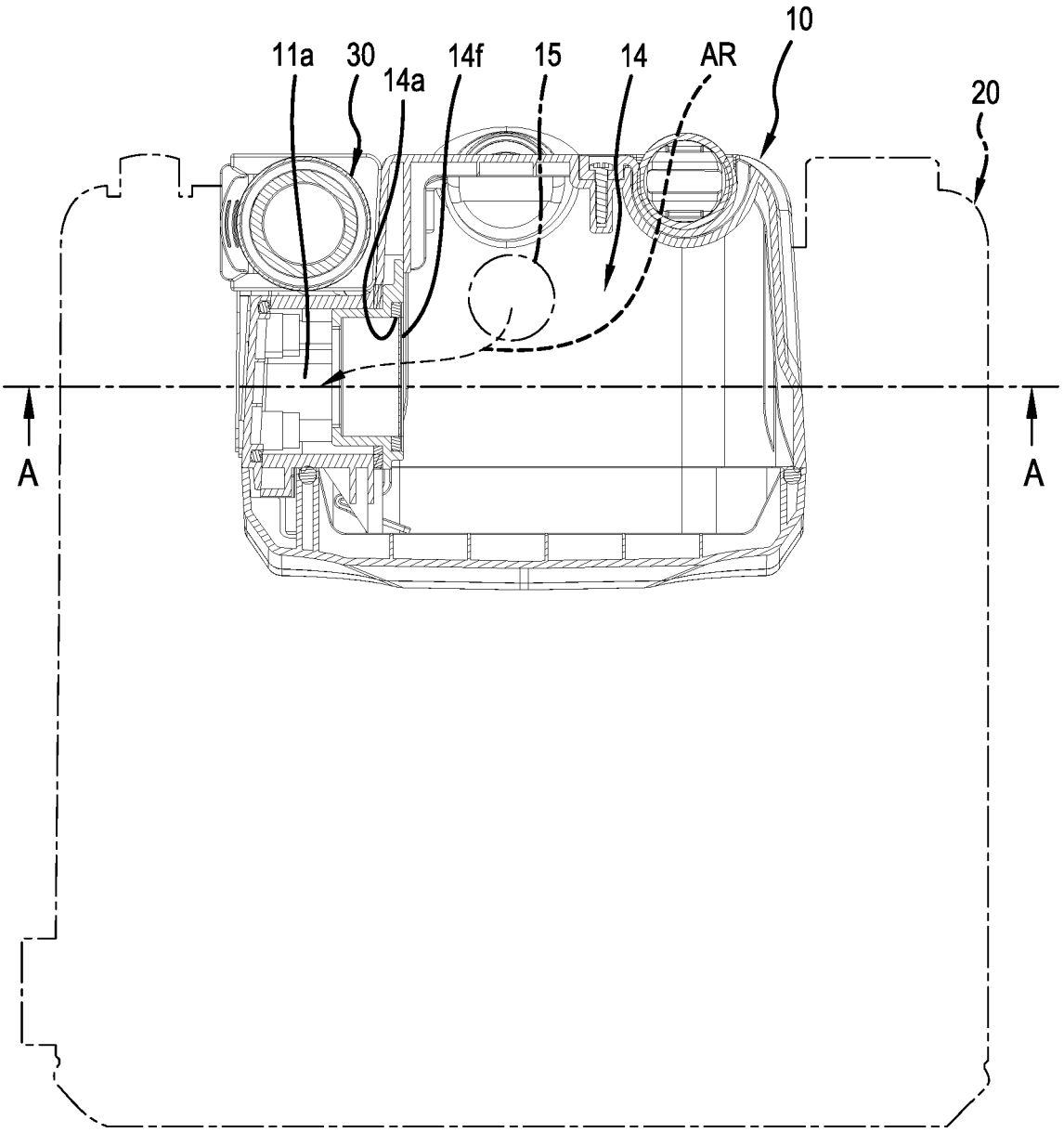
FIG. 8 is a plan view of the main-body part.

A motor chamber 13 and a dust-collection chamber 14 are defined within the housing 11. FIGS. 5-8 show one exemplary example of the interior of the main-body part 10, in which FIG. 5 is a cross-sectional view, FIG. 6 and FIG. 7 are oblique views, and FIG. 8 is a plan view. It is noted that FIG. 5 shows a configuration along a cross-section taken along line A-A in FIG. 8. In addition, FIG. 6 shows the state in which the open/close cover 12 in FIG. 1 has been removed. FIG. 7 shows the state in which, starting from the state shown in FIG. 6, a filter 14*f*, which is described below, has been removed.

As shown in FIGS. 5-8, the motor chamber 13 is disposed on (defined in) a lower side (portion) of the interior of the housing 11. The motor chamber 13 fluidly communicates with a passageway (tube) 11*a* via an opening 13*a*. The passageway 11*a* is disposed on the right side of the housing 11 and extends in the up-down direction. The motor chamber 13 contains an electric motor 13*m* and a suction fan 13*f*. More specifically, the suction fan 13*f* is disposed between the electric motor 13*m* and the opening 13*a*. A suction force is generated when the electric motor 13*m* rotates the suction fan 13*f*. Air suctioned by this suction force is exhausted externally via (through), for example, an exhaust port 18 of the housing 11.

The dust-collection chamber 14 is disposed on (defined in) an upper side (portion) of the interior of the housing 11. The open/close cover 12 can be moved to open and close the dust-collection chamber 14. A dust-collection pack (not shown), which is configured to store foreign matter suctioned by the cleaner head 20, is mountable in (and preferably removable from) the dust-collection chamber 14. The dust-collection pack may comprise a flexible (e.g., paper) bag or a rigid plastic bin, such as a cyclone dust separator. The dust-collection chamber 14 fluidly communicates with the above-mentioned passageway 11*a* via an opening 14*a*. The opening 14*a* is formed in a right-side surface of the dust-collection chamber 14. The filter 14*f* is provided such that it is mountable on (in) the opening 14*a* and is removable therefrom. The filter 14*f* collects fine dust that was not collected by (in) the dust-collection pack. The passageway 11*a* fluidly communicates with the motor chamber 13 via the opening 13*a*. A coupling pipe 15, which fluidly communicates with the connecting pipe 30, is provided on (in) an upper part of the dust-collection chamber 14. The dust-collection chamber 14 fluidly communicates with the connecting pipe 30 via the coupling pipe 15.

A handle 16 is provided on an upper part of the housing 11 and is graspable by a user to move the upright vacuum cleaner 100. A manual operation switch (not shown) is provided on the handle 16 and is preferably positioned so that it is manually operable with the same hand that is grasping the handle 16. The manual operation switch is an electronic switch that is configured/adapted to process various manual operations for the upright vacuum cleaner 100. For example, the manual operation switch may have a DRIVE (ON) switch and a STOP (OFF) switch, or may be simply operable to change between ON (connected) state and an OFF (disconnected) state.

The cleaner head 20 comprises a cleaner head housing 21 and two or more (rear) wheels or castors 22. The cleaner head housing 21 is movable along the floor surface while the cleaner head housing 21 is placed on the floor surface. The cleaner head housing 21 comprises a suction opening 23, a suction passageway (tube) 24, two battery-mounting parts 26, and a cover 25.

The suction opening 23 has a rectangular shape (see FIG. 3) and extends along a front portion of a bottom surface 21*a* of the head housing 21. The suction opening 23 is disposed such that its center in the left-right direction coincides with, for example, the center of the head housing 21 in the left-right direction. A rotary brush 23*a* is disposed in the suction opening 23. The rotary brush 23*a* is rotatable about a central axis, which is parallel to the left-right direction. By rotating the rotary brush 23*a*, foreign matter, such as dust, that has adhered to a portion of the floor, such as a carpet, may be dislodged more effectively so that such foreign matter can be suctioned more easily.

The suction passageway 24 directs air, which has been sucked in via the suction opening 23, and any foreign matter, such as dust, entrained therein to flow to the connecting pipe 30. The suction passageway 24 is disposed in a central portion of the interior of the head housing 21 in the left-right direction and extends rectilinearly (straight) in the front-rear direction. That is, the suction passageway 24 is provided rectilinearly such that it passes through the central portion of the cleaner head 20 in plan view. A front end of the suction passageway 24 is fluidly connected to the suction opening 23, and a rear end of the suction passageway 24 is fluidly connected to a coupling pipe 27.

The suction passageway 24 is fluidly connected to a central portion of the suction opening 23 in the left-right direction. Because the suction passageway 24 is disposed in the central portion in the left-right direction and is fluidly connected to the central portion of the suction opening 23 in the left-right direction, the suction force act equally in (uniformly across) the left-right direction in the suction opening 23. The coupling pipe 27 is disposed on a rear part of the cleaner head housing 21 and fluidly couples the suction passageway 24 to the connecting pipe 30. Because the suction passageway 24 is provided rectilinearly (extends straight) in the front-rear direction from the suction opening 23 to the coupling pipe 27, the dimensions of the cleaner head housing 21 can be reduced and suction losses are minimized, thereby ensuring a sufficient suction force.

The cover 25 is provided such that it is capable of opening and closing an upper portion of the cleaner head housing 21. The cover 25 is pivotably mounted along a front end of the head housing 21 via a (not shown) hinge. Therefore, the cover 25 is pivotable about a central axis that is parallel to the left-right direction. The upper portion of the cleaner head housing 21 is openable and closable by pivoting the cover member 25. When the cover 25 is in the closed state, it covers the battery-mounting parts 26 (see FIGS. 1, 2, and 4).

Figure 9:
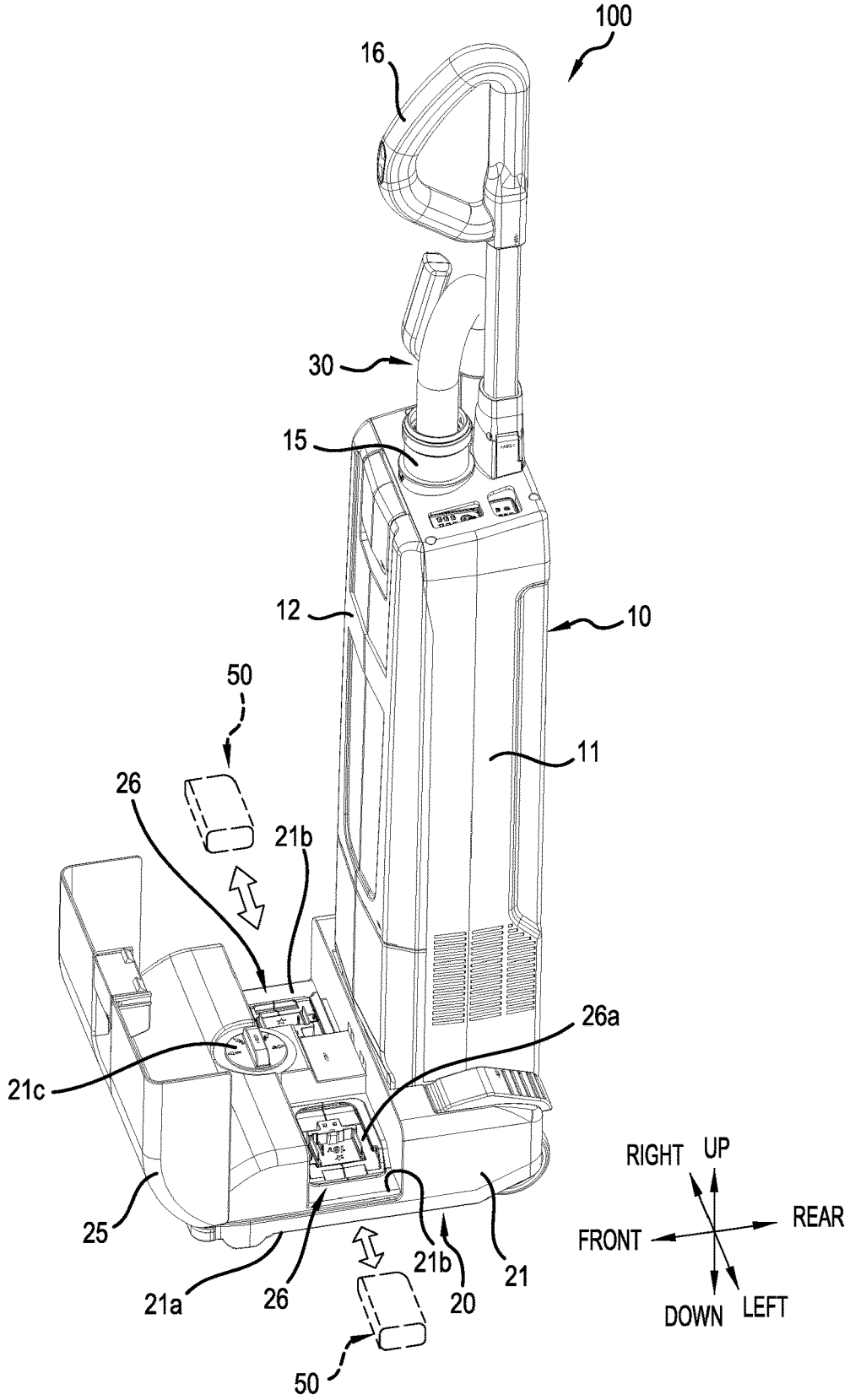
FIG. 9 is an oblique view that shows the first embodiment with a cover member in an open state.

FIG. 9 is an oblique view that shows one exemplary example of the cover 25 pivoted to the open state. As shown in FIG. 9, the battery-mounting parts 26 can be exposed by opening the cover 25 so that batteries (battery packs, battery cartridges) 50 can be mounted on the battery-mounting parts 26 or removed therefrom. Thus, the cover 25 protects the batteries 50 when the batteries 50 are mounted on the battery-mounting parts 26 or protects terminals of the battery-mounting parts 26 that connect to the batteries 50 when the batteries are not mounted thereon, thereby inhibiting (blocking) the adherence of dust, etc. to the battery-mounting parts 26. The cover 25 may be transparent or semitransparent, in which case the user can view the interior of the cleaner head housing 21 even if the cover member 25 has been pivoted to its closed position.

The battery-mounting parts 26 are respectively disposed at locations spaced apart (outward in the left-right direction) from the suction passageway 24 in plan view, and the batteries 50 are respectively mountable on the battery-mounting parts 26. For example, in the first embodiment, the battery-mounting parts 26 are respectively disposed on both sides of the suction passageway 24 in the left-right direction.

The battery-mounting parts 26 include recessed parts 21*b*, which are provided in the cleaner head housing 21 and are configured to respectively house the batteries 50. Thus, by housing the batteries 50 in the recessed parts 21*b* within the head housing 21, the height (the dimension in the up-down direction) of the cleaner head housing 21 can be reduced as compared to embodiments in which, for example, the batteries 50 are mounted on an upper surface of the cleaner head housing 21.

Figure 10:
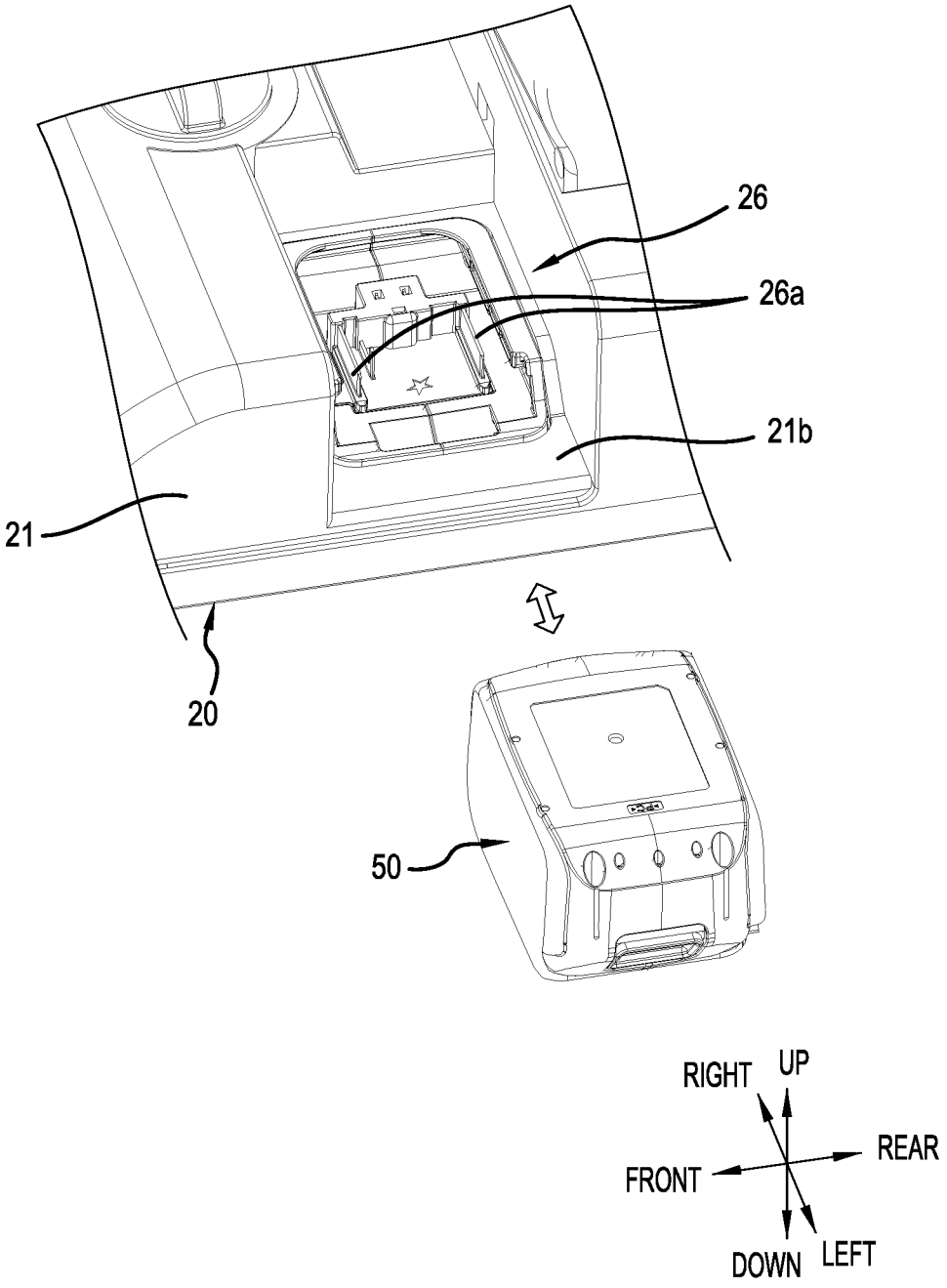
FIG. 10 is an oblique view that shows an enlargement of a portion of a cleaning head housing.

FIG. 10 is an oblique view that shows an enlargement of a portion of the cleaner head housing 21 and shows one exemplary example of the left-side battery-mounting part 26. As shown in FIGS. 9 and 10, each of the battery-mountings part 26 has two rails 26*a* that extend parallel to the left-right direction. In other words, the two rails 26*a* are aligned and spaced apart in the front-rear direction. Each pair of rails 26*a* guides one of the batteries 50 when the battery 50 is being mounted by being slid in the left-right direction (transverse direction) from the outer side toward the inner side in the left-right direction.

For example, with regard to the battery-mounting part 26 disposed on the left side of the suction passageway 24, the battery 50 is mountable by being slid in the right direction from the left side of the cleaner head housing 21. When the battery 50 is to be removed, the battery 50 is removable by being slid in the direction the reverse of that when being mounted, that is, in the left direction.

In addition, with regard to the battery-mounting part 26 disposed on the right side of the suction passageway 24, the battery 50 is mountable by being slid from the right side of the cleaner head housing 21 in the left direction. When the battery 50 is to be removed, the battery 50 is removable by being slid in the direction the reverse of that when being mounted, that is, in the right direction.

Figure 11:
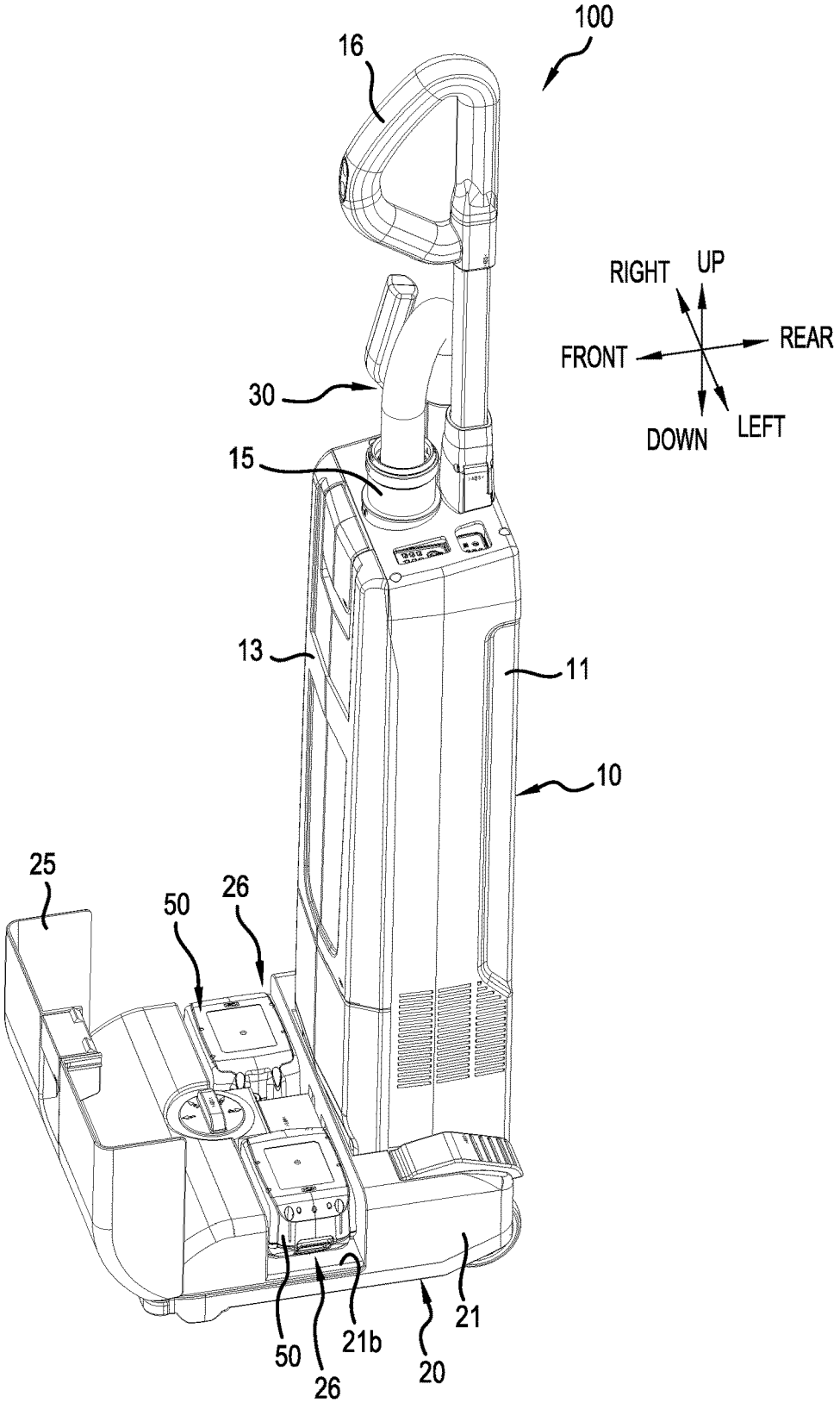
FIG. 11 is an oblique view that shows batteries mounted in a cleaner head.
Figure 12:
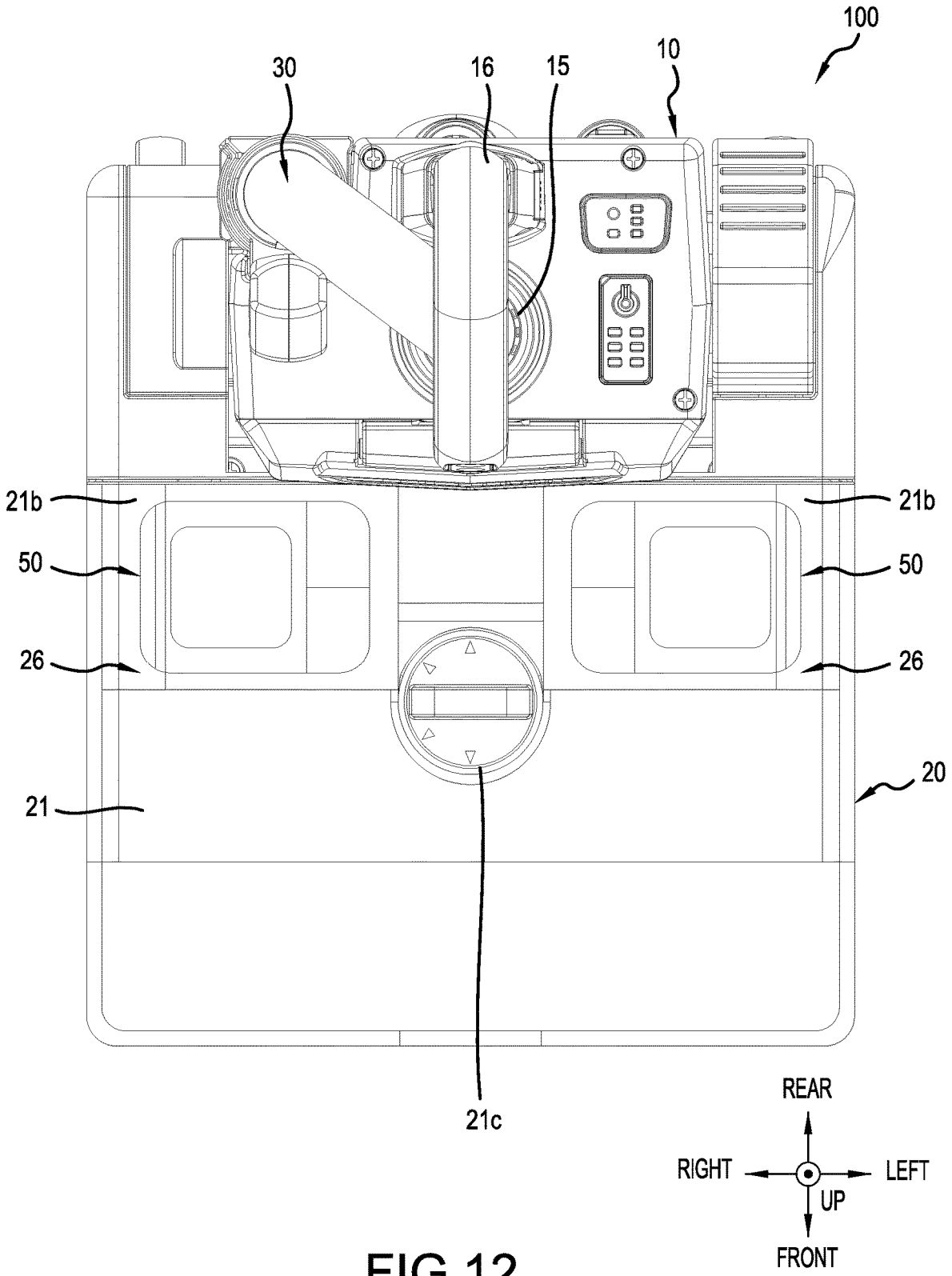
FIG. 12 is a plan view of the batteries mounted in the cleaner head.

FIGS. 11 and 12 show one exemplary example of the state in which the batteries 50 are mounted in the cleaner head 20, in which FIG. 11 is an oblique view and FIG. 12 is a plan view. As shown in FIGS. 11 and 12, when mounted, the batteries 50 are housed inside the recessed parts 21*b* of the cleaner head housing 21. Consequently, the external dimensions of the cleaner head housing 21 do not change regardless of whether the batteries 50 are mounted.

In the first embodiment, the batteries 50 are, for example, batteries designed for use with power tools, such as cordless driver-drills, cordless saws, etc., and preferably comprise a hard plastic shell (housing) that contains a plurality of battery cells, such as lithium ion battery cells or battery cells based upon another battery chemistry. The battery (battery pack or battery cartridge) 50 may also comprise a controller (microprocessor, memory, etc.) that performs various battery functions, such as checking the remaining battery capacity, storing battery usage history, communicating signals to a controller within the power tool, etc. However, it is noted that the batteries 50 are not limited to power-tool batteries and may be, for example, general-purpose batteries that are usable in other vacuum cleaners. The batteries 50 may be rechargeable. It is noted that, the upright vacuum cleaner 100 may also be configured such that it is powered by a power supply other than the batteries 50.

In addition, the above-mentioned rear wheels 22 and two auxiliary wheels 28 are provided on the bottom surface 21*a* of the head housing 21. The rear wheels 22 are respectively disposed on the left and right rear parts of the bottom surface 21*a*. The rear wheels 22 are rotatable about a central axis, which is parallel to the cleaner head 20 in the left-right direction. By rotating the rear wheels 22, the cleaner head 20 is easily movable in the front-rear direction.

The auxiliary wheels 28 are disposed on a central portion of the bottom surface 21*a* in the left-right direction. The auxiliary wheels 28 are disposed such that they protrude downward from the bottom surface 21*a*, for example, between the left and right battery-mounting parts 26 in plan view, but the location of the auxiliary wheels 28 is not limited thereto. The auxiliary wheels 28 are rotatable about a central axis, which is parallel to the left-right direction. The amount of protrusion of the auxiliary wheels 28 downward from the bottom surface 21*a* is adjustable by a height-adjusting part 21*c*, which is disposed on an upper surface of the cleaner head housing 21. By the adjusting of the amount of downward protrusion of the auxiliary wheels 28, the distance between the rotary brush 23*a* and the floor surface can be adjusted.

The connecting pipe 30 fluidly connects the main-body part 10 to the cleaner head 20. In the first embodiment, the connecting pipe 30 fluidly connects the coupling pipe 15 of the main-body part 10 to the coupling pipe 27 of the cleaner head 20. The connecting pipe 30 is disposed (extends) in the up-down direction along the right side of the main-body part 10. Because the main-body part 10 and the cleaner head 20 are fluidly connected by (via) the connecting pipe 30, air and foreign matter, such as dust, can be suctioned in from the suction opening 23 of the cleaner head 20 using the suction force generated in the motor chamber 13 of the main-body part 10.

A method for operating the above-described upright vacuum cleaner 100 will now be explained. First, the user may determine whether electric power can be supplied to the upright vacuum cleaner 100. For example, the user can verify whether the batteries 50 are mounted on the battery-mounting parts 26 by opening the cover 25 of the cleaner head 20, or by looking through a transparent or semi-transparent cover 25 that is in the closed state. If the batteries 50 are not mounted on the battery-mounting parts 26, then one or two of the batteries 50 are mounted on the battery-mounting parts 26. In this embodiment, the batteries 50 can be mounted easily by being slid from the outer side of the head housing 21 in the left-right direction. In addition, if the batteries 50 are to be exchanged, then the batteries 50 can be easily removed by being slid in the reverse direction of the mounting direction.

After the batteries 50 have been mounted, or after it has been verified that the batteries 50 are mounted, the user grasps the handle 16 of the main-body part 10, sets the main-body part 10 to the desired orientation (i.e. upright or tilted relative to the floor surface), and manually operates the DRIVE switch. When the DRIVE (ON) switch is actuated, a suction force is generated in the motor chamber 13 and air is sucked in via the suction opening 23 of the cleaner head 20. Thereby, foreign matter, such as dust, on the floor surface is sucked in.

The user may then move the cleaner head 20 in the front-rear direction by grasping and maneuvering the handle 16. In addition, if the main-body part 10 is tilted relative to the floor surface while the user grasps the handle 16, the user may turn the handle 16 about an axis that is parallel to the up-down direction to rotate the cleaner head 20, and thereby change the direction of travel. When the cleaner head 20 moves in the front-rear direction, the rotary brush 23*a* rotates. Thereby, for example, foreign matter that is caught in a carpet or the like can be brushed up (dislodged) by the rotary brush 23*a*.

The air and foreign matter that is sucked in flows through the suction passageway 24 and reaches the coupling pipe 27. In the first embodiment, the suction passageway 24 is disposed in the center in the left-right direction and is connected to the center of the suction opening 23 in the left-right direction. Consequently, suction can be performed equally in (uniformly across) the left-right direction of the suction opening 23. In addition, because the suction passageway 24 is disposed rectilinearly (extends straight) in the front-rear direction, suction force losses are minimized as compared to embodiments in which the suction passageway 24 has been routed in a bent state within the head housing 21. Consequently, air and foreign matter can be suctioned with sufficient suction force.

The air and foreign matter that reaches the coupling pipe 27 then flows to the dust-collection chamber 14 via the connecting pipe 30 and the coupling pipe 15. The foreign matter is stored inside the dust-collection pack of the dust-collection chamber 14. As shown in, for example, FIG. 5, air (AIR) flows into the passageway 11*a* via the filter 14*f* and the opening 14*a* of the dust-collection chamber 14. When the air passes through the filter 14*f*, fine foreign matter that was not collected by (in) the dust-collection pack is collected (filtered) by the filter 14*f*. The air that flows into the passageway 11*a* is sucked into the motor chamber 13 via the passageway 11*a* and the opening 13*a*. This air passes through the fan 13*f* and the motor 13*m* in the motor chamber 13 and is exhausted externally via the exhaust port 18. It is noted that a passageway may be configured such that air that passes through the fan 13*f* and the motor 13*m* flows across a control board (not shown) to cool it.

When the STOP switch is manually actuated, the suction force is no longer generated in the motor chamber 13, and thus suctioning through the suction opening 23 of the cleaner head 20 stops. Thereby, operation of the upright vacuum cleaner 100 stops. When the upright vacuum cleaner 100 is to be put away after operation stops, it can be stored, for example, as is in the state in which the main-body part 10 is stood upright relative to the floor surface.

As described above, the upright vacuum cleaner 100 according to the first embodiment comprises the main-body part 10 that includes the coupling pipe 15, the dust-collection chamber 14 fluidly connected to the suction opening 23, e.g., via a coupling pipe 15, the motor chamber 13 fluidly connected to the dust-collection chamber 14 and in which the fan 13*f* and the motor 13*m* are housed, and the exhaust port 18 through which air is exhausted from the motor chamber 13. The main-body part 10 can be maintained in the state in which the main-body part 10 stands upright relative to the floor surface. The upright vacuum cleaner 100 further comprises: the cleaner head 20, which is pivotably connected to the main-body part 10 and suctions air owing to the suction force generated in the motor chamber 13; the suction passageway 24, which is disposed inside the cleaner head 20, is provided rectilinearly (extends straight) such that it passes through the central portion of the cleaner head 20 in plan view, and through which suctioned air flows toward the main-body part 10; and the batteries 50, which are disposed at locations within the cleaner head 20 that are spaced apart (outward) from the suction passageway 24 in plan view.

According to the first embodiment, because the batteries 50 are disposed in the cleaner head 20, the vacuum cleaner 100 can be moved (manipulated) more easily than in embodiments in which the batteries 50 are disposed in the main-body part 10, because the main-body part 10 does not include the weight of the batteries 50. In addition, the suction passageway 24 is provided rectilinearly (extends straight) such that it passes through the central portion of the cleaner head 20 in plan view. Consequently, suction force losses in the cleaner head 20 are minimized as compared to configurations in which the suction passageway has been routed in a bent state within the head housing 21. Consequently, the upright vacuum cleaner 100 of the first embodiment is easy to use and provides a sufficient suction force at the suction opening 23.

Furthermore, in the upright vacuum cleaner 100 according to the first embodiment, the batteries 50 are provided such that they are mountable on (in) the cleaner head 20 and removable therefrom. Therefore, the batteries 50 can be easily exchanged.

In the upright vacuum cleaner 100 according to the first embodiment, the batteries 50 are respectively disposed at a plurality of locations. Thereby, it becomes possible to select between an operating mode in which only one battery 50 is mounted and an operating mode in which a plurality of the (e.g., two) batteries 50 is mounted. For example, if the upright vacuum cleaner 100 is expected to be used for only a short time, only one battery 50 may be mounted. On the other hand, if the upright vacuum cleaner 100 is expected to be used for a long time, a plurality of the batteries 50 may be mounted, thereby minimizing the need to exchange batteries 50 during operation.

For example, when the batteries 50 are disposed (mounted) on both sides of the suction passageway 24 in plan view, it is possible to ensure that the weight on the left and right of the cleaner head 20 is balanced, thereby improving maneuverability and suction uniformity.

In the upright vacuum cleaner 100 according to the first embodiment, the cleaner head 20 comprises the rails 26*a*, on which the batteries 50 are respectively mountable in a simple manner by being slid.

Furthermore, the battery-mounting parts 26 of the first embodiment include the recessed parts 21*b*, which are provided in the cleaner head housing 21 for respectively housing the batteries 50. Because the batteries 50 are respectively housed in the recessed parts 21*b*, the height (the dimension in the up-down direction) of the cleaner head housing 21 can be reduced as compared to an embodiment in which, for example, the batteries 50 are mounted on an upper surface of the cleaner head housing 21.

In the upright vacuum cleaner 100 according to the first embodiment, the batteries 50 are may be power tool batteries or general-purpose batteries, which permits the batteries 50 to be shared with other vacuum cleaners, power tools, and the like.

Moreover, the cleaner head 20 of the first embodiment comprises the pivotable cover 25 that covers the batteries 50 in the closed state, thereby protecting the mounted batteries 50 or the terminals of the battery-mounting parts 26 that connect to the batteries 50 to minimize the adherence of dust or the like to the battery-mounting parts 26.

The technical scope of the present invention is not limited to the above-mentioned embodiments, and modifications can be added as appropriate within a range that does not depart from the gist of the present invention. For example, in the first embodiment, an exemplary configuration was described that utilizes a single (integral) cover 25 to cover both of the two battery-mounting parts 26, but embodiments of the present teachings are not limited thereto. Two or more covers may be provided that are configured to individually open and close the respective battery-mounting parts 26.

In addition, the first embodiment utilizes two (a plurality) of the batteries 50 and two (a plurality) of the battery-mounting parts 26, but embodiments of the present teachings are not limited thereto. For example, a configuration may be used in which one battery 50 and one battery-mounting part 26 are provided. In the alternative, a configuration may be used in which three or more of the batteries 50 and three or more of the battery-mounting parts 26 are provided.

In addition, in the first embodiment, the batteries 50 are respectively disposed at locations on both sides of the suction passageway 24 in plan view, but embodiments according to the present teachings are not limited thereto. Instead, both of the batteries 50 may be provided on one (the same) side of the suction passageway 24 in plan view.

In addition, the upright vacuum cleaner 100 of the first embodiment is configured such that the motor chamber 13 is disposed within the main-body part 10, but embodiments of the present teachings are not limited thereto. For example, the upright vacuum cleaner may have a configuration in which the motor chamber is disposed within the cleaner head 20.

Additional aspects of the present teachings include, but are not limited to:

1. An upright vacuum cleaner (dust collector) (100) having a main-body part (10) that includes a coupling pipe (15), a dust-collection chamber (14) fluidly connected to the coupling pipe, a motor chamber (13) fluidly connected to the dust-collection chamber and in which a fan (13*f*) and a motor (13*m*) are housed, and an exhaust port (18) through which air is exhausted from the motor chamber, the main-body part being maintainable in the state in which the main-body part stands upright relative to a floor surface, the upright vacuum cleaner (100) further comprising:

a cleaner head (20), which is pivotably and fluidly connected to the main-body part and is adapted to suction air through a suction opening (23) when the fan and motor generate a suction force;

a suction passageway (24), which is disposed inside the cleaner head, is provided rectilinearly (extends straight) such that it passes through a central portion of the cleaner head in plan view, and through which suctioned air flows to the main-body part; and one or more batteries (50) disposed at a location or locations within the cleaner head that is/are spaced apart (outward) from the suction passageway in plan view.

2. The upright vacuum cleaner (100) according to the above Aspect 1, wherein the one or more batteries (50) is/are provided such that it is (they are) mountable on the cleaner head (20) and demountable therefrom.

3. The upright vacuum cleaner (100) according to the above Aspect 1 or 2, wherein two or more of the batteries (50) are respectively disposed at a plurality of locations.

4. The upright vacuum cleaner (100) according to the above Aspect 3, wherein the two or more of the batteries (50) are respectively disposed at locations on both sides of the suction passageway (24) in plan view.

5. The upright vacuum cleaner (100) according to the above Aspect 2, wherein the cleaner head (20) has one or more rails (26*a*) for slidably mounting the battery or batteries (50).

6. The upright vacuum cleaner (100) according to any one of the above Aspects 1-5, wherein:

the cleaner head (20) has a cleaner head housing (21); and the cleaner head housing has one or more recessed parts (21*b*) configured to house the battery or batteries (50).

7. The upright vacuum cleaner (100) according to any one of the above Aspects 1-6, wherein the battery (50) is a general-purpose battery.

8. The upright vacuum cleaner (100) according to any one of the above Aspects 1-7, wherein the cleaner head (20) includes a cover (25) that is capable of opening and closing and that covers the one or more batteries (50) in its closed state.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved upright vacuum cleaners and methods of using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

10 Main-body part (main casing)
11 Housing
12 Open/close cover
13 Motor chamber
14 Dust-collection chamber
15, 27 Coupling pipes
16 Handle
17 Coupling part
18 Exhaust port
20 Cleaner head
21 Cleaner head housing
21*a* Bottom surface
21*b* Recessed part
21*c* Adjustment part
22 Rear wheel
23 Suction opening
23*a* Rotary brush
24 Suction passageway
25 Cover
26 Battery-mounting part
26*a* Rail
28 Auxiliary wheel
30 Connecting pipe
50 Battery
100 Upright vacuum cleaner

We claim:

1. An upright vacuum cleaner, comprising:

a main casing that includes a dust-collection chamber fluidly connected to a motor chamber via a coupling pipe;

a fan and a motor disposed in the motor chamber and configured to generate a suction force;

an exhaust port defined in the main casing and configured to exhaust air from the motor chamber;

a cleaner head pivotably connected to the main casing and having a suction opening configured to suction in air when the suction force is generated by the fan and motor;

a straight suction passageway disposed inside the cleaner head and extending through a central portion of the cleaner head in plan view, the straight suction passageway being a portion of a fluid connection between the suction opening and the motor chamber;

a first battery disposed within the cleaner head spaced apart from the suction passageway in the plan view; and a second battery that is detachably mountable on the cleaner head;

wherein the main casing is configured to stand upright relative to the cleaner head in a first direction of the cleaner head, the suction opening has a longest extension in a second direction of the cleaner head that is perpendicular to the first direction of the cleaner head, the suction opening being disposed at a first end of the cleaner head in a third direction of the cleaner head that is perpendicular to both the first and second directions of the cleaner head, the first battery is disposed on a first side of the straight suction passageway and the second battery is disposed on a second side of the straight suction passageway that is opposite of the first side of the straight suction passageway in the plan view, the upright vacuum cleaner further comprises:

first and second wheels rotatably mounted on a first surface of the cleaner head that is opposite of the main casing in the first direction, the first and second wheels being respectively disposed on the first and second sides of the straight suction passageway in the second direction; and a pair of auxiliary wheels disposed between the first and second batteries in the second direction, and the first and second batteries are located between the first and second wheels and the suction opening in the third direction.

2. The upright vacuum cleaner according to claim 1, wherein the cleaner head has first and second pairs of rails configured to respectively slidably mount the first and second batteries.

3. The upright vacuum cleaner according to claim 2, wherein:

the cleaner head includes a cleaner head housing; and two recessed parts are defined on the cleaner head housing and are configured to respectively house the first and second batteries.

4. The upright vacuum cleaner according to claim 3, wherein the first and second batteries are each a rechargeable battery pack configured to be interchangeably used on another type of vacuum cleaner or power tool.

5. The upright vacuum cleaner according to claim 4, further comprising:

a cover configured to open and close the cleaner head housing, wherein the cover encloses the first and second batteries when the cover closes the cleaner head housing.

6. An upright vacuum cleaner, comprising:

a main casing that includes a dust-collection chamber fluidly connected to a motor chamber via a coupling pipe;

a fan and a motor disposed in the motor chamber and configured to generate a suction force when the motor rotates the fan;

an exhaust port defined in the main casing and configured to exhaust air from the motor chamber;

a cleaner head pivotably connected to the main casing via a hinge and having a suction opening configured to suction in air when the suction force is generated by the fan and motor;

first and second battery-mounting parts respectively provided in first and second recessed parts of the cleaner head;

a straight suction tube disposed inside the cleaner head and extending between the first and second battery-mounting parts in plan view, the straight suction tube constituting a portion of a fluid connection between the suction opening and the motor chamber;

first and second rechargeable batteries respectively mounted on the first and second battery-mounting parts to supply current to rotatably drive the motor;

first and second wheels rotatably mounted on a first surface of the cleaner head that is opposite of the main casing in the first direction; and a pair of auxiliary wheels rotatably mounted on a central portion of the first surface of the cleaner head;

wherein the main casing is configured to stand perpendicular relative to the cleaner head in a first direction of the cleaner head, the suction opening is rectangular and has a longest extension in a second direction of the cleaner head that is perpendicular to the first direction of the cleaner head, the straight suction tube is perpendicular to both the first and second directions of the cleaner head and is fluidly connected to the suction opening, each of the first and second battery-mounting parts has a pair of rails configured to respectively detachably mount the first and second rechargeable batteries, each of the pair of rails extends in the second direction of the cleaner head, such that the first and second rechargeable batteries are mountable by being slid in the second direction, the first and second wheels are disposed on opposite sides of the straight suction tube in the second direction, the first and second rechargeable batteries are located between the first and second wheels and the suction opening in the third direction, and the pair of auxiliary wheels is disposed between the first and second rechargeable batteries in the second direction.

7. The upright vacuum cleaner according to claim 6, wherein:

the first and second rechargeable batteries each have a height in the first direction; and the straight suction tube extends between the height of the first and second rechargeable batteries in the first direction.

8. The upright vacuum cleaner according to claim 7, further comprising:

a cover configured to open and close an interior portion of the cleaner head housing that contains the first and second rechargeable batteries, wherein the cover encloses the first and second rechargeable batteries when the cover closes the cleaner head housing.

9. The upright vacuum cleaner according to claim 6, further comprising:

a rotatable brush disposed in the suction opening and extending in the second direction.

10. The upright vacuum cleaner according to claim 6, further comprising:

a height-adjusting part is disposed on a second surface of the cleaner head that is closest to the main casing in the first direction, wherein the height-adjusting part is configured to manually adjust an amount of protrusion of the auxiliary wheels downward below the first surface of the cleaner head.

* * * * *